United States Patent [19]

Mochel

[11] 4,050,399

[45] Sept. 27, 1977

[54] ATTACHMENT FOR MOTORCYCLES

[76] Inventor: Ashton Mochel, Rte. 7, Forest Road, Conroe, Tex. 77301

[21] Appl. No.: 646,664

[22] Filed: Jan. 5, 1976

[51] Int. Cl.[2] ..... B63H 1/00

[52] U.S. Cl. ..... 115/71

[58] Field of Search ..... 115/.5 R, .5 A, .5 B, 115/2, 18 A, 70, 22, 26, 71; 114/66.5 F, 281

[56] References Cited

U.S. PATENT DOCUMENTS

| | | | |
|---|---|---|---|
| 615,871 | 12/1898 | Muller | 115/2 |
| 3,155,185 | 11/1964 | Allen et al. | 115/2 |
| 3,456,613 | 7/1969 | Smith | 115/70 |
| 3,709,185 | 1/1973 | Hennel | 115/.5 A |
| 3,826,216 | 7/1974 | Rhody | 115/.5 A |
| 3,854,436 | 12/1974 | Cox | 115/.5 A |

FOREIGN PATENT DOCUMENTS

| | | | |
|---|---|---|---|
| 460,828 | 12/1950 | Italy | 115/.5 A |
| 927,304 | 5/1963 | United Kingdom | 115/70 |

*Primary Examiner*—Trygve M. Blix
*Assistant Examiner*—Jesus D. Sotelo
*Attorney, Agent, or Firm*—Ranseler O. Wyatt

[57] ABSTRACT

Attachments for motorcycles permitting a conversion of the vehicle to a water borne vehicle, including hinged frameworks controlled and operated by pneumatic or hydraulic cylinders or the like, on which are mounted rotatable propeller for suitable floats and suitable water propulsion. The float members are designed to include, if desired, battery operated propellers either as substitute or as auxiliary propulsion for the vehicle, when being used on water.

4 Claims, 6 Drawing Figures

ATTACHMENT FOR MOTORCYCLES

BACKGROUND OF THE INVENTION

Conventional motorcycles are intended for use on land only, and when ice, snow, water, mud, and the like are encountered, the vehicle is of little use as a means of transportation. It is an object of this invention to provide a vehicle having attachments that may be moved into and out of vehicle supporting position for travel over all types of terrain.

SUMMARY OF THE INVENTION

A motorcycle attachment having frameworks on which flotation means are mounted and a separate framework on which propulsion means are mounted and having suitable power means for pivoting said framework on the vehicle and means for transmission of propulsion power from the rear wheel of the motorcycle to said propulsion means, when the propulsion framework is lowered into operating position.

DESCRIPTION OF THE PREFERRED EMBODIMENT

Figure 1:
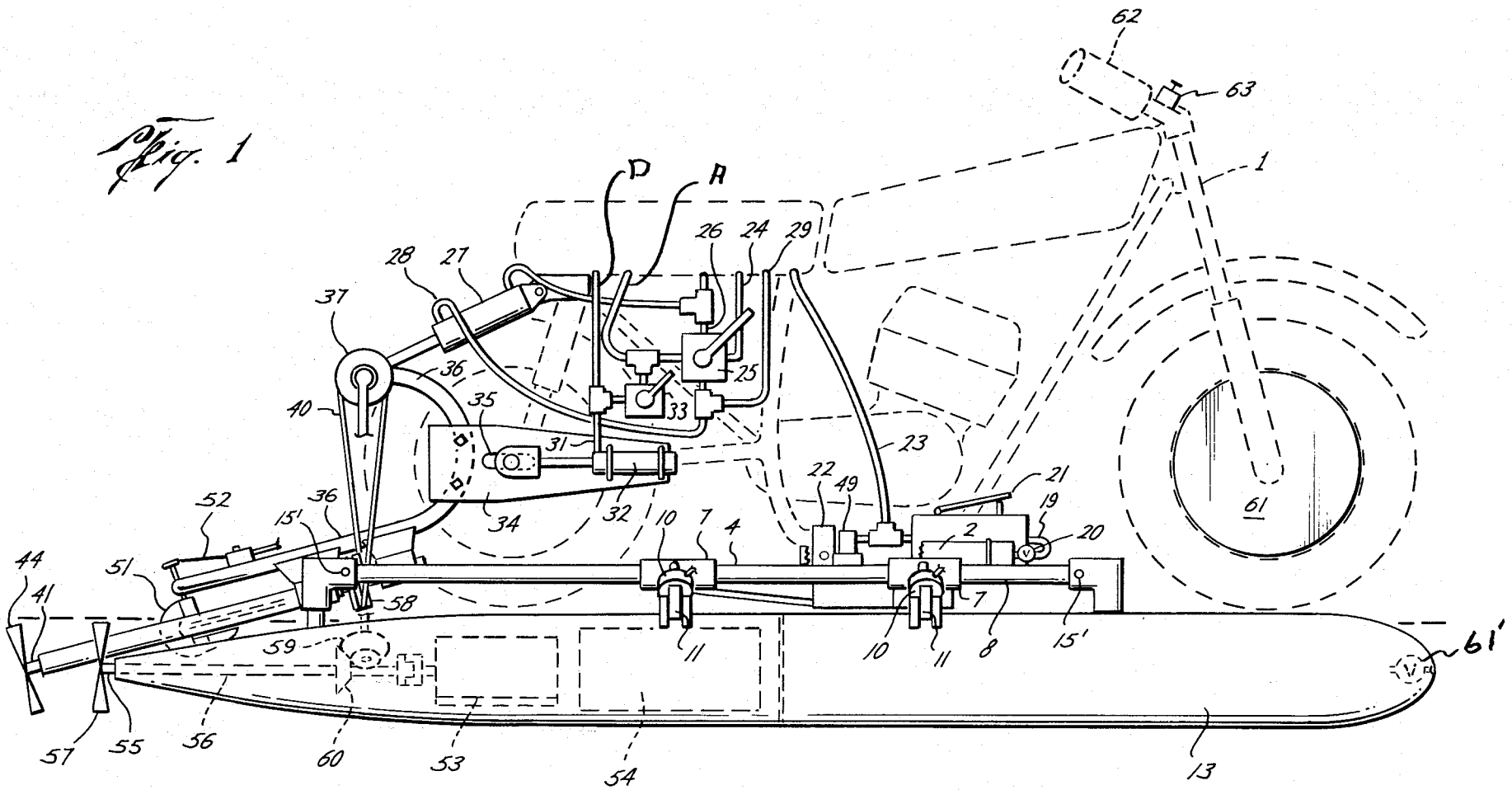
FIG. 1 is a side view of the motorcycle with the framework supporting the float and the framework supporting the propulsion means in operating position.
Figure 2:
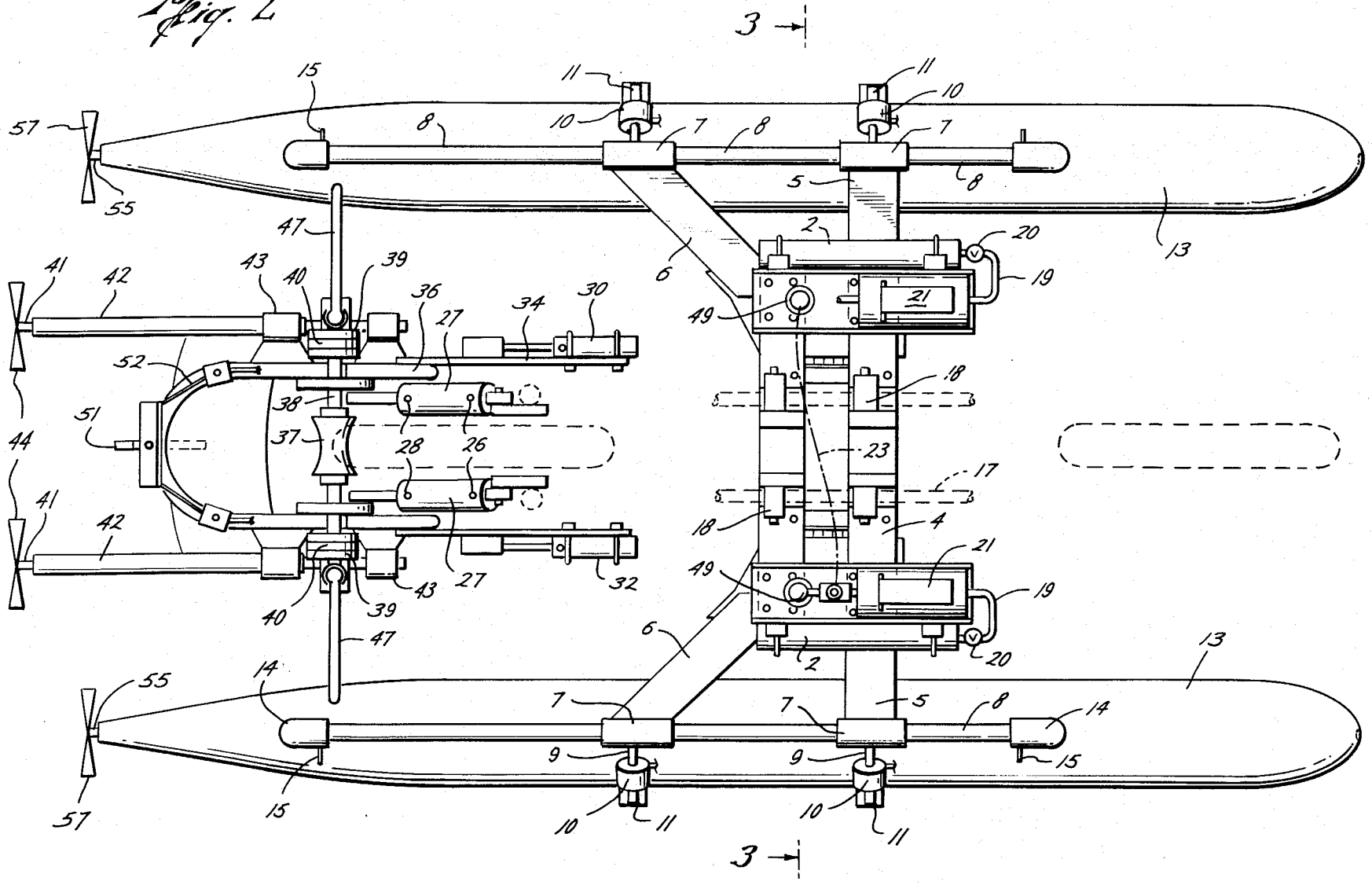
FIG. 2 is a tip plan view of the view shown in FIG. 1, showing the rotation and propulsion frameworks and the floats and propulsion means mounted thereon.
Figure 3:
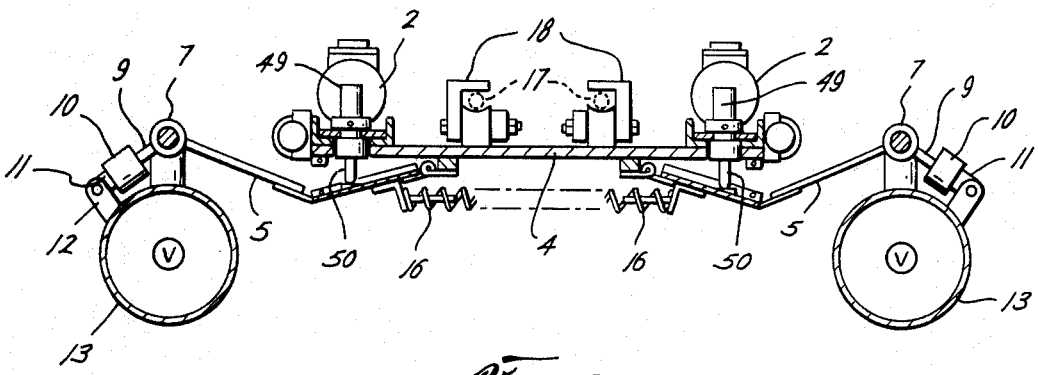
FIG. 3 is an end view in cross section taken on the lines 3—3 of FIG. 2.
Figure 4:
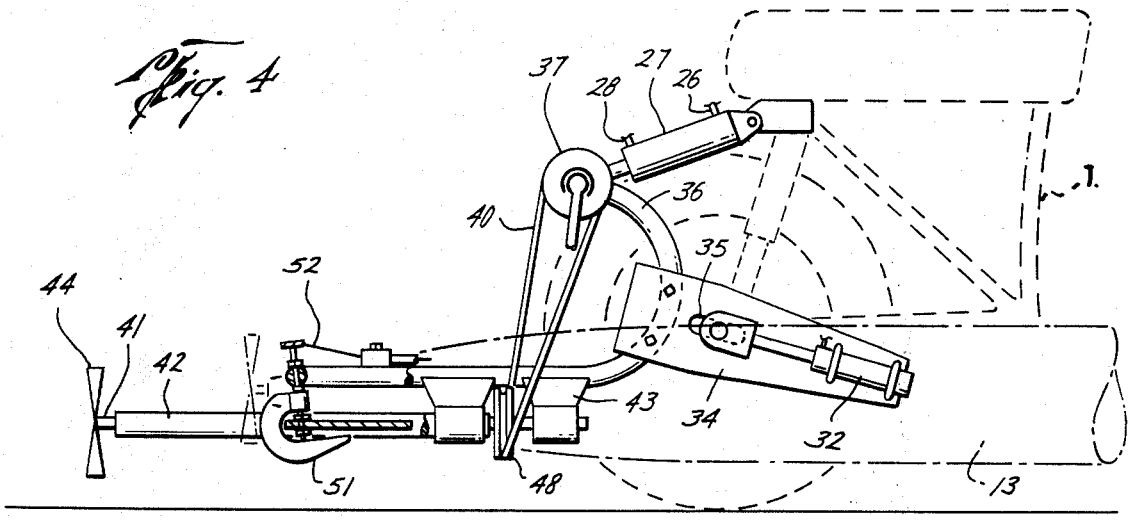
FIG. 4 is a side elevational view of the propulsion means elevated out of operating position.
Figure 5:
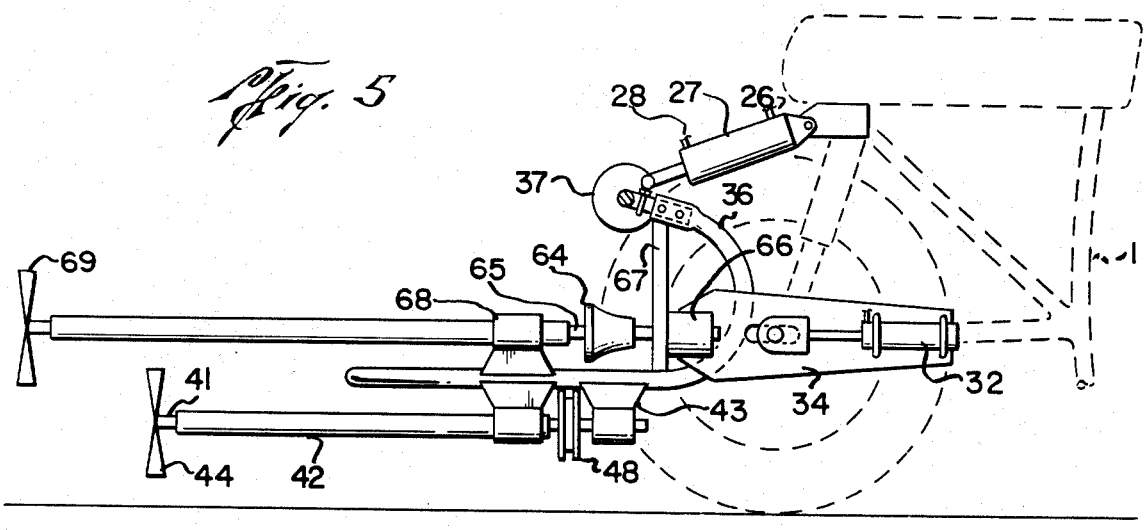
FIG. 5 is a partial side elevational view, showing the reversing mechanism installed.
Figure 6:
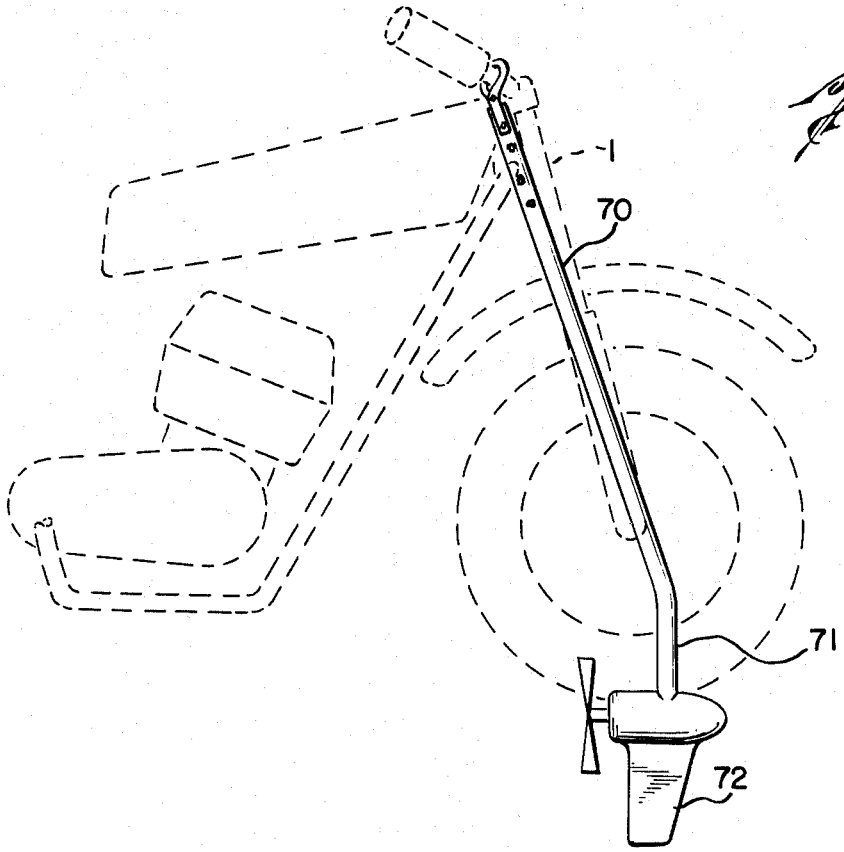
FIG. 6 is a partial side elevational view showing an auxillary steering means employed.

In the drawings, the numeral 1 designates a motorcycle, shown in dotted lines, having the usual framework, and on which is mounted the pivotal float framework 4 having laterally extending float support arms 5,5, and laterally and rearwardly extending arms 6,6, the extended ends of said arms terminating in the tubular members 7,7, which are mounted on the longitudinal float support member 8, and extending downwardly and outwardly from each of the members 7 is a piston rod 9, which extends into the air cylinders 10, 10 the opposite ends of each of the cylinders 10 having a pivotal connection 11 with the respective arms 12,12, said arms being integral with and extending upwardly and outwardly from the float 13. A control 63 on the handlebars controls the air cylinders 10. The respective ends of the float support members 8 extend into the tubular elbows 14, 14, and the orifices 15', 15', in the respective ends of the float supports 8, receive the locking pins 15, 15, when the floats are in raised position. Coil springs as 16, 16, mounted on the frame 4, bear against and constantly urge the arms 5, 6, into upper position. The framework 4 extends beneath the vehicle framework 17 and the framework 4 is clamped by the clamping means 18, 18, to the vehicle frame.

Suitable pressure tanks as 2, 2, are mounted on the framework 4 on the respective sides of the vehicle, and leading therefrom are the pneumatic lines 19, 19, in which gauges 20, 20, are mounted, and which lead through a control 21. The hydraulic line has a pump 22 mounted therein and continues as 23 to the other side of the vehicle where a similar set of hydraulic lines are mounted and which extend into the line 24 and control 25 which has a line 26 leading therefrom to one end of the jacks 27, 27, and the return lines 28, 28, lead back into a return line 29. The control 25 also directs the flow of pneumatic pressure into the line A which leads to the jack 30 and the line 31 which leads to the jack 32. The control 33 is mounted in the line system, A, D, and directs pressure into the jacks 32 and out of same.

Pivotally mounted on the axle of the rearwheel of the vehicle is the framework support 34 in which is formed an elongated slot 35 which receives the axle permitting longitudinal movement of the support 34 on said axle by means of the jack 32 mounted on one side of the vehicle and the support 34 is similarly mounted on the other side of the vehicle and is moved longitudinally by means of the jack 30. The propulsion framework 36 is mounted on the support 34 and one end of the framework 36 is upwardly and rearwardly turned and on said end of said framework is mounted the propulsion transmission means which consists of the roller 37 mounted on the shaft 38, the terminal ends of said shaft having the pulleys 39, 39, on which the belts 40, 40, are mounted. Propeller shafts 41, 41, are pivotally mounted in the tubular housing 42, 42, and said housings are pivotally mounted in the connecting members 43, 43, integral with the framework 36. Telescoping supports 47, 47 extend from the ends of the shaft 38, to the floats 13, 13, and propellers as 44, 44, are mounted on the ends of the shaft 41 and are rotated by the pulleys 48, 48, which are in turn rotated by the belt 40. Pneumatic jacks 49, 49, are mounted on the framework 4, and have a reciprocating member as 50, 50, bearing against the respective float support arms 5, 5.

In operation, while traveling on land, the floats 13, 13, will be in raised position where they will have a stabilizig effect on the vehicle as it is operated and which will present lateral barriers for protection of the rider in the event of collisions, or upset of the vehicle. When desired to take the vehicle onto a body of water, mud, snow, or the like, the pins 15, 15, are removed and the control 21 is depressed at the forward end causing a pneumatic pressure flow to the jacks 49, 49, forcing the members 50, 50 against the float support arms 5, moving same downwardly against the pressure of the coil springs 16, 16, and as the floats move downwardly they will pivot outwardly until in level position, the air cylinders 10 providing further outward movement, if desired, the control 63 on the vehicle handlebars providing selective electronic control of said cylinders, assuring the proper alignment of the floats with the vehicle. The control 25 is actuated to apply pressure to the jacks 27, 27, to bring the roller 37 into contact with the rear wheel of the vehicle, the said jacks 27, 27, being pivoted to the vehicle framework to permit constant contact with the tire as the supports 34 are moved and the control 33 is actuated to apply pressure to the jacks 32, 32, moving the supports 34, 34, outwardly as the framework 36 moves downwardly. To retract the float framework, the control 21, is moved in the opposite direction, relieving the pneumatic pressure and the springs 16 moving the arms 5, 6, upwardly, and the pins 5 replaced when the floats are in raised position. The controls 25 are reversed moving the roller 37 out of contact and the control 33 reversed, moving the supports 34, 34, rearwardly.

A rudder 51 is mounted between the propeller shaft 42, 42, on the framework 36 and cables as 52 extend along the framework of the vehicle to the handlebars, so that as the handlebars are manipulated to turn the front wheel, the said rudder 51 will be simultaneously moved in the direction desired.

If desired, auxiliary power units may be supplied by electric motors as 53 mounted in the respective floats 13 powered by batteries as 54 and having propeller shafts 55 and housing 56 and propellers as 57 mounted on said shafts 55. Also, if desired, the transmission or rotation from the roller 37 to the belt 40 may be continued by a belt 58 extending from a suitable pulley (not shown) mounted on the drive shafts 41. This power would be transmitted by means of the pinion gears 59, 60 to the propellers 57, 57 to aid in the propulsion of the device.

A suitable valve as 61' may be mounted in the forward end of each of the floats in the event it is desired to submerse, as in skin diving, in which event the user may operate the propellers 57 by means of the electric motor 53 while the vehicle is submersed.

As may be seen from above, the pontoons or floats may be lowered to any degree desired. The roller 37 remaining engaged with the tire of the vehicle with the jack 27 pivoting on its pivotal mount as the support 34 moves longitudinally, consequently, the pontoons may be employed to support the vehicle or to give balance or auxiliary support as when traveling over snow or mud or the like, as well as when lowered to its lowest position to provide flotation.

When traveling over snow or ice, the floats 13, 13, will be lowered a sufficient distance to provide support for the vehicle, but permitting the rear wheel to remain in contact with the road surfce, or surface of the terrain, to provide propulsion of the vehicle.

When the vehicle is on water, the propellers 44 will be below the water surface, and the front end of the vehicle will be only partially submersed. A solid disc 61 may be mounted on the front wheel so that it will assist in guiding the travel of the vehicle. The rudder 51 will control the direction of travel, assisted by the said disc 61, as the handlebars 62 are manipulated. When the floats are adjusted for such terrain as snow and ice, the propulsion frame may remain out of operation.

The reversing mechanism employed consists of the cone-shaped rollers 64, which are mounted on the framework 36 upon each side of the rear tire and which engage the side surfaces of the tire of the rear wheel, and which are rotated by the rear wheel, and which are mounted on and rotate the drive shafts, as 65, which are mounted at one end in the bearings, as 66, and the brace 67 on the framework 36, and the bearings, as 68, also mounted on the framework 36. Propellers as 69 are mounted on the extended end of the respective shafts 65, and are provided with a much greater pitch than the other propellers. The propulsion means 69 are normally above the surface of the water, being arranged vertically at a horizontal level above the other shafts when the said other drive shafts are submersed and the propellers thereon are driving forward, so that by further lowering the framework 36, the propellers 69 are submersed, and, being of a greater pitch than the forward driven propellers, and being directly driven from the tires without pullely intervention, will turn in the opposite direction from the direction of rotation of the other propellers, and will overcome the drive of the forward driving propellers will brake the forward movement of the vehicle and move the vehicle rearwardly when the forward movement has ceased. This provides the vehicle with brakes, which will allow the user to slow down, stop or move rearwardly.

For further steering, small outboard motors as 70 may be mounted on the handlebars of the motorcycle, with their shafts, as 71, rearwardly bent to offset the normally raised position of the front wheels, and the rudder 72 extended downwardly below that normally found on these small motors, so that by starting the outboard motors 70, and manipulating the steering wheel and handlebars, additional steering is available. In quiet water, if desired, these may also provide forward motion, without employing the usual power means, or in the event of failure of the vehicle motor, the outboard motors 70 may furnish the necessary power to make a landing.

What I claim is:

1. In an attachment for motorcycles, a frame adapted to be mounted on the framework of a motorcycle, pivotal supporting arms on said frame, the extended ends of said arms supporting flotation means, a propulsion framework pivotally mounted on said motorcycle framework, having propulsion means mounted thereon, and means for selective transmission of power to said propulsion means from said motorcycle, pneumatic means mounted on said frame having conduits on said motorcycle for selectively actuating said arms and said propulsion framework.

2. The device defined in claim 1 wherein said means for transmission of power consists of a roller mounted on said propulsion means framework, having means for moving said roller into and out of contact with the rear wheel of said vehicle, a drive shaft extending from said roller having propulsion pulleys on the respective ends thereof, and belts mounted on and rotated by said pulleys, and propellers mounted on said propulsion means rotated by the rotation of said pulleys.

3. The device defined in claim 1 wherein each of said flotation means being provided with a longitudinal supporting bar which is received by the extended ends of said supporting arms and pivot thereon, a connecting arm extending from said flotation means adjacent the juncture of each supporting arm and the flotation supporting bar, and an air cylinder between each said juncture and the connecting arm for selectively extending the flotation means.

4. The device defined in claim 1 wherein said propulsion means have forward drive propellers rotated through pulleys, belts and drive shafts, mounted on said propulsion framework, cone shaped rollers mounted on said framework adapted to selectively bear against the sides of the rear tire of the motorcycle to drive said drive shafts, reverse drive propellers having a greater pitch than the said forward drive propellers, mounted on said drive shafts in a position to be selectively submersed to overcome the forward drive and reverse the movement of the vehicle.

* * * * *